US010426311B2

(12) United States Patent
Whitbread et al.

(10) Patent No.: US 10,426,311 B2
(45) Date of Patent: Oct. 1, 2019

(54) LIQUID DISPENSING APPARATUS

(71) Applicant: Steam E Holdings Limited, Hampshire (GB)

(72) Inventors: Martin Whitbread, Hampshire (GB); Jared Brading, Hampshire (GB)

(73) Assignee: Steam E Holdings Limited, Fareham (GB)

( * ) Notice: Subject to any disclaimer, the term of this patent is extended or adjusted under 35 U.S.C. 154(b) by 0 days.

(21) Appl. No.: 15/522,669

(22) PCT Filed: Oct. 29, 2015

(86) PCT No.: PCT/GB2015/053241
§ 371 (c)(1),
(2) Date: Apr. 27, 2017

(87) PCT Pub. No.: WO2016/067031
PCT Pub. Date: May 6, 2016

(65) Prior Publication Data

US 2017/0319040 A1 Nov. 9, 2017

(30) Foreign Application Priority Data

Oct. 30, 2014 (GB) ..... 1419365.0
Jun. 18, 2015 (GB) ..... 1510744.4

(51) Int. Cl.
*B43K 5/02* (2006.01)
*A47L 11/40* (2006.01)
(Continued)

(52) U.S. Cl.
CPC ..... *A47L 11/4088* (2013.01); *A47L 11/4086* (2013.01); *A47L 13/225* (2013.01);
(Continued)

(58) Field of Classification Search
CPC . A47L 11/4086; A47L 11/4088; A47L 13/225
(Continued)

(56) References Cited

U.S. PATENT DOCUMENTS 4,308,636 A * 1/1982 Davis ..... A47L 11/34 15/321
4,508,957 A 4/1985 Rocchitelli
(Continued)

FOREIGN PATENT DOCUMENTS

GB 2384845 A 1/2002
KR 20070119256 A 12/2007
(Continued)

OTHER PUBLICATIONS

International Preliminary Report on Patentability from counterpart International Application No. PCT/GB2015/053241, dated May 11, 2017, 7 pp.
(Continued)

*Primary Examiner* — Jennifer C Chiang
(74) *Attorney, Agent, or Firm* — Shumaker & Sieffert, P.A.

(57) ABSTRACT

A portable liquid dispensing apparatus is described, which comprises a battery, a heating element, a liquid reservoir, a pump, an outlet, and a pipe, extending from the reservoir to the outlet and passing adjacent the heating element. In operation, the pump drives liquid from the reservoir into and through the pipe while the power source causes the heating element to heat the liquid passing through the portion of the pipe adjacent to the heating element to be expelled from the outlet at a temperature greater than the ambient temperature.

14 Claims, 5 Drawing Sheets

Figure 1:
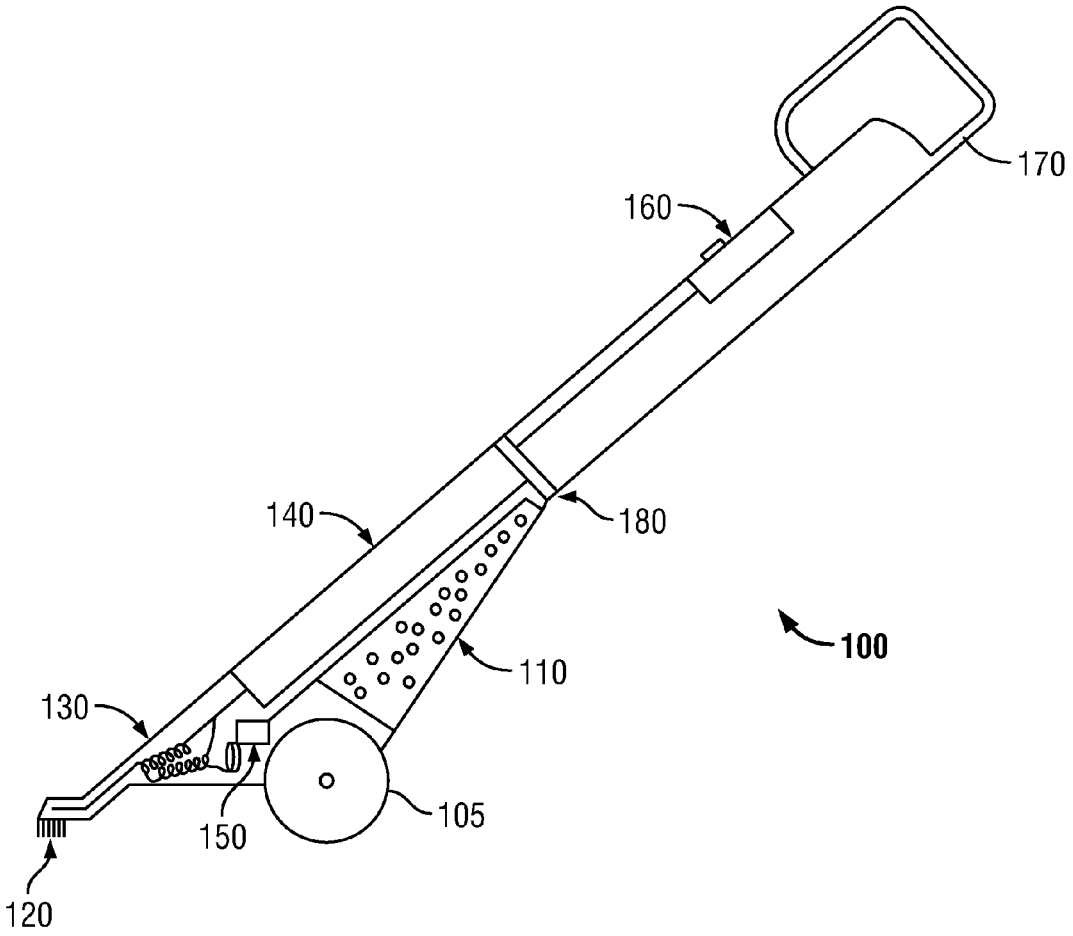

(51) Int. Cl.

| | |
|---|---|
| ***A47L 13/22*** | (2006.01) |
| ***B05C 1/00*** | (2006.01) |
| ***B05C 1/06*** | (2006.01) |
| ***H05B 3/00*** | (2006.01) |

(52) U.S. Cl.
CPC ..... *B05C 1/003* (2013.01); *B05C 1/06* (2013.01); *H05B 3/0014* (2013.01); *H05B 2203/021* (2013.01)

(58) Field of Classification Search
USPC ..... 401/188 R, 138
See application file for complete search history.

(56) References Cited

U.S. PATENT DOCUMENTS

| | | | | |
|---|---|---|---|---|
| 6,502,275 | B1 | 1/2003 | Hsieh | |
| 8,534,301 | B2 * | 9/2013 | Nottingham | A47L 13/22 134/105 |
| 9,173,540 | B2 * | 11/2015 | Scolari | A47L 13/225 |
| 9,560,948 | B2 * | 2/2017 | Huang | A47L 9/16 |
| 2002/0026954 | A1 | 3/2002 | Tyler et al. | |
| 2003/0233727 | A1 | 12/2003 | Wheeler et al. | |
| 2006/0188241 | A1 | 8/2006 | Higham et al. | |
| 2006/0249186 | A1 | 11/2006 | Cohen et al. | |
| 2007/0193451 | A1 | 8/2007 | Brown et al. | |
| 2010/0212688 | A1 | 8/2010 | Goff | |
| 2010/0232772 | A1 | 9/2010 | Chiu et al. | |
| 2013/0187461 | A1 | 7/2013 | Goto et al. | |
| 2014/0103023 | A1 | 4/2014 | Kao | |
| 2014/0245560 | A1 | 9/2014 | Huang et al. | |
| 2014/0259478 | A1 | 9/2014 | Conrad | |
| 2014/0259510 | A1 * | 9/2014 | Conrad | A47L 13/225 15/319 |
| 2016/0022110 | A1 * | 1/2016 | Genoa | A47L 11/4086 15/320 |

FOREIGN PATENT DOCUMENTS

| | | | |
|---|---|---|---|
| KR | 20090108328 | A | 10/2009 |
| WO | 2005/018837 | A1 | 3/2005 |
| WO | 2010069356 | A1 | 6/2010 |
| WO | 2013092235 | A1 | 6/2013 |
| WO | 2014159513 | A1 | 10/2014 |

OTHER PUBLICATIONS

Search Report under Section 17(5) dated Dec. 8, 2015 in counterpart GB Application No. 1510744.4, 5 pgs.
Search Report and Written Opinion dated Jan. 27, 2016 in counterpart PCT Application No. PCT/GB2015/053241, 10 pgs.

* cited by examiner

LIQUID DISPENSING APPARATUS

This application is a U.S. national phase application under 37 U.S.C. § 371 of international application number PCT/GB2015/053241 filed on Oct. 29, 2015, which claims the benefit of priority to GB application number 1510744.4 filed Jun. 18, 2015 and GB application number 1419365.0 filed Oct. 30, 2014. The entire contents of each of international application number PCT/GB2015/053241 and GB application numbers 1510744.4 and 1419365.0 are incorporated herein by reference.

FIELD OF THE INVENTION

The present invention relates to a heated liquid or steam dispensing apparatus. Embodiments of this invention relate to a gum removal apparatus, cleaning apparatus or weed killing apparatus and the associated generation of heated liquid or steam from battery power, for these and other tasks, as part of an apparatus which dispenses said steam or heated liquid to perform its function.

BACKGROUND TO THE INVENTION

Used chewing gum is frequently discarded onto floors and other surfaces. Chewing gum is particularly difficult to remove by mechanical means, and it has been found that the best technique for removing it is to apply steam/vapour to it at the same time as applying a mechanical action, such as brushing/abrading. The steam/vapour breaks down the chewing gum deposit, making removal possible. Previous gum removal equipment comprises a small LPG/Propane gas canister which is used to heat up liquid from a reservoir to produce steam, which can then be dispensed from a nozzle onto a chewing gum deposit. More specifically, this technology involves pumping a pre mixed chemical into a 6 mm stainless steel pipe that is coiled and heated by a flame, powered by the LPG/propane gas. This method allowed the metal to reach a temperature hot enough to turn the liquid into instant steam.

More generally, current methods of producing heated liquid or steam are mainly based on providing a heating element in a boiler. The problem with using a boiler-based system is that it is necessary to deal with the changing pressure that is caused by the water expanding to enable steam to be created. This issue causes steam machines to constantly require replacement "o" rings, which are a weak point, and which fail due to the high pressure being created. The pressure may be so strong that an excessive build up would either damage the "o" rings or result in a ruptured boiler. The water that is heated in the boiler chamber is converted to vapour/steam stage then pumped through to a lance to complete a cleaning task. To use a steam-cleaning machine to remove chewing gum, a separate source of chemical would be attached to the machine. This chemical is pumped from a separate chamber and injected into the steam (usually at the end of the lance) to allow the cleaning process to be effective. The boiler/element systems are very slow to heat up as they work on the principle of a kettle coming to the boil to generate vapour/steam. They also require considerable power, as often they are required to heat between 2 and 5 liters of water to allow the operator to have sufficient steam at point of contact/cleaning. Due to traditional steam machines relying on an ever-changing volume of water in the reservoir they cannot maintain a consistent pressure. When the internal pressure changes and the steam pressure changes the machines stop generating steam and the cleaning process must stop to wait for pressure to build sufficiently for vapour/steam to be generated again. Typically this can take 10 minutes to build. The end result is that the operator of the machine has constantly fluctuating periods of waiting for pressure to build, especially on constant fill machines.

It has also been noted by the applicant that the production of hot water or other fluids form a portable source remains problematic for many of the above reasons. Many cleaning processes are undertaken by machines using cold water, sometimes mixed with harsh, environmentally damaging or poisonous chemicals, to undertake the cleaning process. The safety and efficiency of these cleaning processes could be greatly improved if a portable source of water or other cleaning fluid was readily available, the use of a heated fluid potentially reducing the timescale of the cleaning process and the volume of chemicals required.

The provision of hot water in caravans, recreational vehicles, tents and other mobile abodes may also be problematic. The use of a generator or other existing means of providing a supply of hot water may be undesirable in many situations, due to issues of excessive noise, a lack of portability or the absence of an easily accessible power supply. Again, the provision of an instant supply of hot water in an energy efficient way would be of great advantage to the user. Such a solution would be beneficial in both the leisure and commercial fields, for example in supplying hot water for bathing or, alternatively, for the commercial preparation of food or beverages at a location where a traditional power source such as mains electricity or a generator is not available.

Embodiments of the present invention seek to address these problems.

SUMMARY OF THE INVENTION

According to an aspect of the present invention, there is provided a portable liquid dispensing apparatus, comprising:

a battery a heating element;

a liquid reservoir;

a pump;

an outlet; and a pipe, extending from the reservoir to the outlet and passing adjacent the heating element;

wherein, in operation, the pump drives liquid from the reservoir into and through the pipe while the power source causes the heating element to heat the liquid passing through the portion of the pipe adjacent to the heating element to be expelled from the outlet at a temperature greater than the ambient temperature.

Preferably, the fluid is heated to a temperature at least 10 degrees Centigrade, more preferably to a temperature at least 40 degrees Centigrade and more preferably still to a temperature at least 100 degrees Centigrade. Such an increase in the temperature of the fluid compared to the ambient temperature is advantageous as it increases the ability of the fluid to clean surfaces in a cost effective and efficient manner.

Preferably, the temperature of the heated fluid may be controlled via the pump. More preferably, the temperature of the heated fluid may be controlled via the flow rate at which the fluid is pushed, by the pump, through the pipe. Such a method of varying the temperature of the heated fluid is preferable as it provides a continuous spectrum of temperature across which the fluid may be heated. Additionally, the flow rate of the pump made be changed very easily and rapidly by the user, allowing the facile generation of water at varying temperatures above the ambient.

Alternatively, it may be preferable for the temperature of the heated fluid to be controlled via the diameter of the pipe. Varying the diameter of the pipe changes its surface area to volume ratio and thus the rate at which any fluid will be heated in said pipe. Thus, the use of varying pipe diameters, potentially via the provision of different attachments or an adjustable component in the pipe itself, may allow a large variation in the temperature of the heated fluid an apparatus is able to achieve during use.

It may also be preferable for the temperature of the heated fluid to be controlled via the voltage of the battery. Such a method of varying the temperature of the heated fluid is preferable as the user may easily exchange the battery in the apparatus, quickly changing the voltage supplied to the heating element and thus the temperature the heating element achieves. Such an embodiment once again provides a continuous spectrum of temperature across which the fluid may be heated in a manner convenient to the user.

Preferably, the portion of the pipe passing adjacent to the heating element is coiled around the heating element, although it will be appreciated that non-coiled configurations which still permit adequate heat transfer from the heating element to the pipe could be used instead. It may also be preferable for the configuration of the heating element to be changed by the user to effect a change in the temperature of the heated liquid exiting the apparatus.

By heating the liquid in a coiled copper pipe, extending around a small probe / element, it is possible to generate liquid to remove chewing gum without the need for mains electrical power or LPG/Propane gases.

Preferably, the heating element is proximate the outlet. As a result, the liquid is generated substantially at the position it is required to be dispensed, improving efficiency and reducing losses which would inevitably result from conveying heated liquid large distances.

Preferably, the apparatus comprises a housing, and the power source is contained within or mounted onto the housing.

In one embodiment, the pipe is coiled around a second heating element. The pipe may be coiled around the heating element and the second heating element individually to form a coiled heating unit, and the pipe be further coiled around the coiled heating unit.

The heating elements and the portion of the pipe coiled around the heating elements may be mounted within a heat insulating material.

The liquid converted to a heated liquid may comprise water, and/or may comprise a chemical agent, such as a cleaning agent or weed killer for example The power source may comprise a battery, which is preferably rechargeable. Preferably, said battery may be a lithium ion battery. It may also be preferable for the battery to have an output voltage of 33.3V, as a battery of this voltage may provide the optimum balance between the size of the liquid dispensing apparatus and the time it may be used for before it requires recharging. Alterative battery voltages may be preferable if a different balance between portability and the frequency of recharging events is desirable.

Preferably, the portable liquid dispensing apparatus comprises a brush, and the outlet dispenses the heated liquid through or adjacent to the brush. In this way, heated liquid can be dispensed to the chewing gum deposit or other area to be cleaned concurrently with a mechanical scrubbing action applied by the brush.

Preferably, the pipe is a copper pipe. More preferably, the copper pipe has an inner diameter of approximately 1 mm. Also preferably, the copper pipe has an outer diameter of approximately 2 mm. Still more preferably, the pump is operable to drive liquid from the reservoir at a rate of approximately 22 ml per minute. The thin walled copper pipe and the transference of heat to the correct amount of liquid flow efficiently generates heated liquid from a low power energy supply, making it possible to remove chewing gum constantly without the problems of changing pressures or risking the use of explosive/highly flammable gases.

The invention also allows for chewing gum removal and steam cleaning at a fast and consistent rate, which is highly beneficial in commercial cleaning activities.

With this apparatus, effective removal of discarded and flattened chewing gum deposits can be achieved. It will be appreciated that such apparatus may also be effective for the removal of residues left by adhesive tapes/flyers/other difficult to remove sticky residues, as well as for chemical free steam cleaning of grouting between tiles, chemical free steam cleaning of other surfaces by using steam, or chemical free weed killing.

The new method of using battery power and the coil system described herein allows for quick generation of heated liquid, but without the risks associated with using a highly explosive gas. The new battery method also eliminates the need for the consumer to commit to ongoing purchases of a fuel source such as LPG/Propane, which is difficult to transport and store due to its hazardous nature.

The present technique does not require a boiler or an immersed element to generate vapour/heated liquid. With current technologies utilising electrical heating, either a mains power source or a portable generator are required to convert the liquid into heated liquid or steam. As a result, there are issues with noise if the machine is being used away from a mains power source, as a generator is required. Existing heated liquid and steam machines draw a minimum of 3000 watts and there are no small silent generators available to solve the noise pollution created. If a mains power source is available then there is the issue of having trailing 240-volt leads, which increases the risk to the operator and any members of the public walking nearby, along with inhibiting the operator's freedom of movement. These issues are avoided, or at least alleviated, by the present technique, which is able to convert water to hot water or steam using a portable battery (pack).

DETAILED DESCRIPTION

The invention will now be described by way of example with reference to the following Figures in which:

FIG. 1 schematically illustrates a gum removal apparatus; and

Figure 2A:
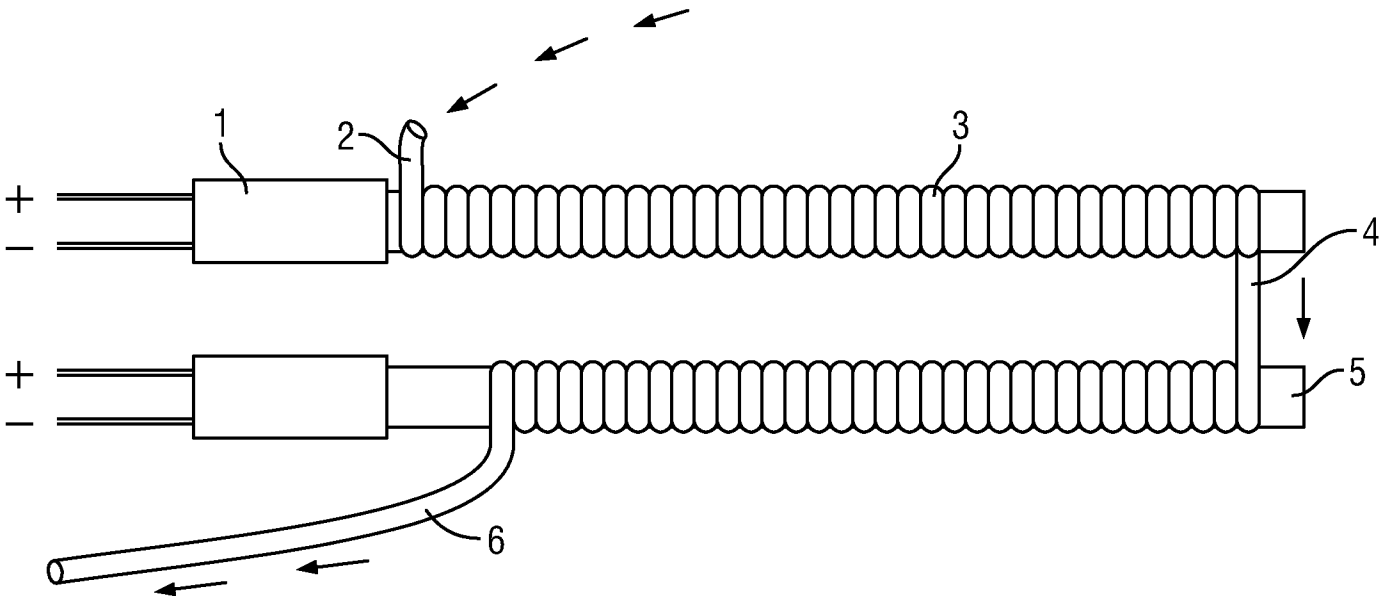
Figure 2B:
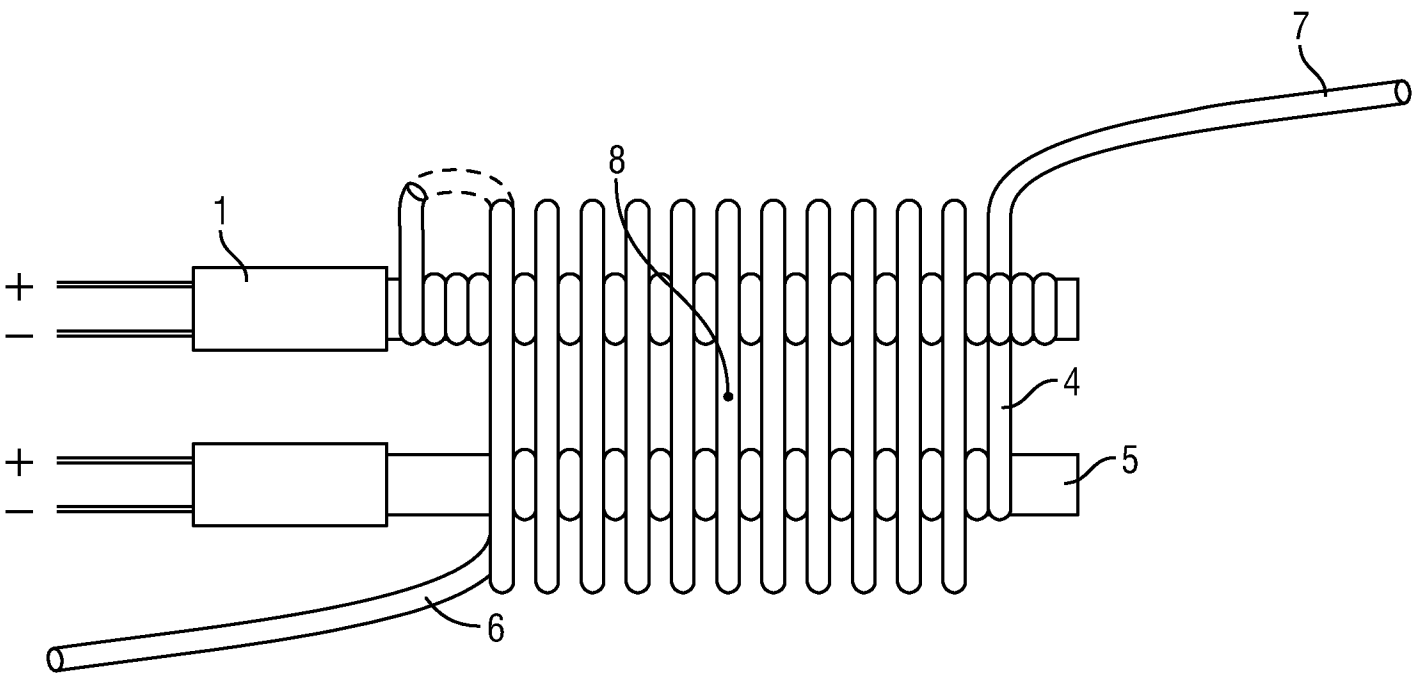

FIGS. 2A and 2B schematically illustrate a heated liquid generating unit for the apparatus of FIG. 1.

Figure 3:
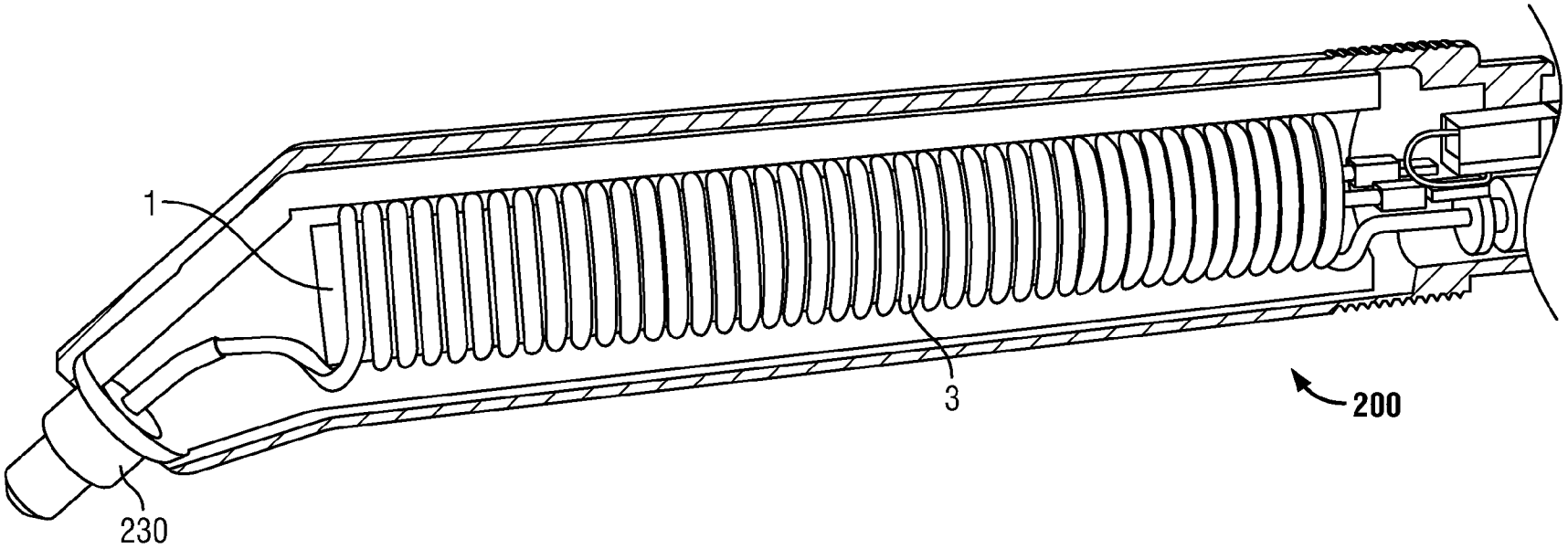
Figure 4:
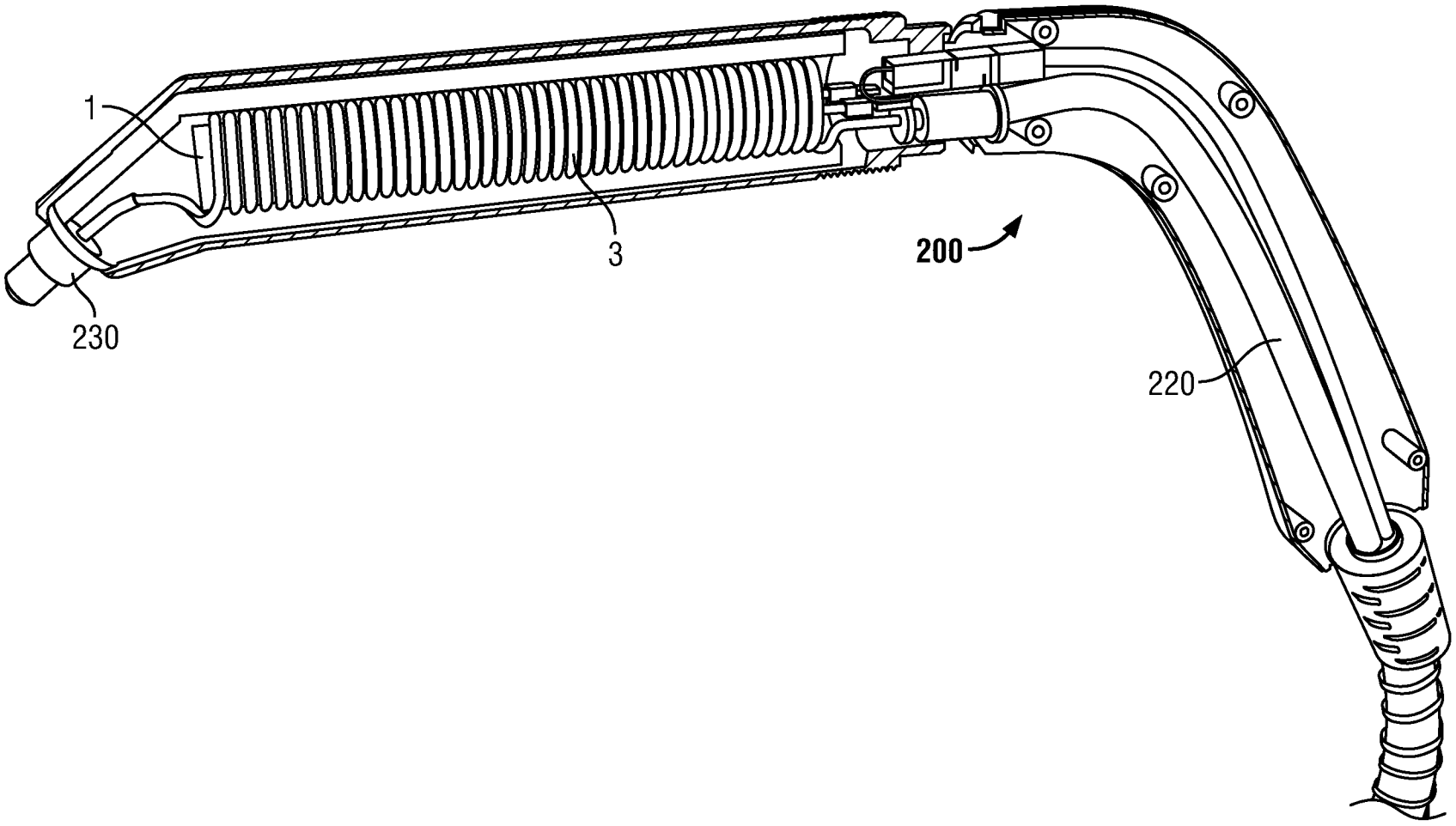

FIG. 3 schematically illustrates an alternative heated liquid generating unit FIG. 4 schematically illustrates the heated liquid generating unit of FIG. 3 connected to a handle Referring first to FIG. 1, a gum removal apparatus 100 is shown schematically. The gum removal apparatus 100 is in this case a floor-based apparatus which can be moved around on wheels 105. It will be appreciated that a hand-held version could be similarly constructed. The gum removal apparatus 100 comprises a water/chemical tank 110, which in this case holds up to 2 liters of water and/or chemicals. If the apparatus is to be used for cleaning (for example) rather than gum removal, water may be used. If the apparatus is to be used for weedkilling, a weedkilling chemical may be used. For gum apparatus, any suitable known chemical for breaking down gum may be used. Preferably, such a chemical should be a non-foaming detergent formulated to not block up the relatively small pitch pipework of the apparatus. A suitable chemical may be formulated from alkyl polyglucoside (5-10% by volume), amphoteric surfactant (10-30% by volume), decyldimethylamine (<0.5% by volume), and water. A pipe or tube extends from the tank 110 to a nozzle 120, passing through a heating unit 130. The heating unit 130 comprises one or more electric heating elements which can be heated by applying electrical power from a battery unit 140 mounted into the device. The pipe coils around the heating elements in the heating unit 130, in a manner which will be described below. The heating unit 130 also comprises thermal insulation which surrounds the heating elements and the part of the pipe which coils around the heating elements. A peristaltic pump 150 with a fixed flow rate is used to drive liquid from the tank 110 through the pipe, and in particular through the heating unit 130 to be boiled, and to be dispensed/expelled from the nozzle 120. It will be appreciated that, provided the pump 150 is providing a constant flow of liquid through the heating unit 130, a relatively constant amount of heat is required to convert the liquid into hot water and/or steam/vapour at the same rate as it is driven through the heating unit 130. This is in contrast to a "boiler" based system in which the amount of heat required varies over time as the amount of liquid in the boiler reduces.

A controller 160, comprising for example a printed circuit board and on/off switch, is provided near to a handle 170 used to move the device around. At its simplest, the device 100 can have a simple on/off operation, with a fixed amount of hot water or steam being ejected through the nozzle 120 when the device is on. However, the device could have multiple settings corresponding to different volumes of hot water and/or steam/vapour being ejected through the nozzle 120. To achieve these different hot water and/or steam flow settings, an increase in liquid flow rate driven by the pump 150 is accompanied by an increase in electrical power applied to the heating elements, resulting in an increased volume of hot water and/or steam expelled from the nozzle. A correspondence between liquid flow rate and the electrical power to be applied to the heating unit 130 is defined in advance and predetermined at the apparatus - the operator is not required to directly modify the liquid flow rare or the applied electrical power in order to obtain hot water and/or steam at the nozzle 120. Towards the centre of the body of the device, a hinge 180 is provided, permitting the device to fold in half for easy transportation. It will be noted that the heating unit 130 is located proximate the nozzle, so that hot water and/or steam is generated very close to the point at which it is to be dispensed.

FIGS. 2A and 2B schematically illustrate the structure of the heating unit 130. Referring to FIG. 2A, a first 100 watt element 1 having a 3.5 mm diameter, has a coil of copper pipe 3 wound around it. The element 1 also has positive and negative terminals, to which electric power is supplied from the battery 140 in order to heat the element 1. The copper pipe 3 has an external diameter of 2 mm and an internal diameter of 1 mm. An inlet 2 to the coil of pipe 3 comes from an outer (secondary) coil 8 (shown in FIG. 2B). A continuation 4 of the pipe 3 then extends across to a second 100 watt element 5, where the pipe 3 coils around the second element 5. The second element 5 is of the same type as the first element 1, and again has positive and negative terminals, to which electric power is supplied from the battery 140. Turning to FIG. 2B, the same parts as shown in FIG. 2A are provided with the same reference numerals. In FIG. 2B, the outer (secondary) coil 8 is shown to coil around the FIG. 1 arrangement of heating elements 1, 5 and coil 3, and to be a continuation of the pipe 3 (via the inlet 2). Liquid enters the outer (secondary) coil 8 via an inlet feed 7 from the pump 150 and tank 110. The liquid then progresses first through the outer coil 8, and then into the primary coil of pipe 3 via the inlet 2. The liquid then progresses through the pipe 3 travelling adjacent to the first element 1 and then the second element 5, before eventually exiting the heating unit via a steam/vapor/hot liquid escape 6. It will be appreciated that the liquid in the feed 7 is relatively cool, but is then pre-heated as it passes around the secondary coil 8, and then heated up as it passes through the pipe 3 adjacent to the first and second elements. The heating elements and coiled pipework are housed within an insulated unit. Insulating the two probes and coils with a high heat resistant material, serves to (a) concentrate any escaping heat back onto the copper coils and (b) protect the surrounding machine parts from any heat escaping from the copper coils, making the machine cool to the touch.

It will be appreciated that this arrangement makes it possible to create heated liquid or steam via a battery power by using a set of electrical probes and copper tubes. Previously, to generate sufficient heated liquid or steam for cleaning purposes existing machines have relied on mains electricity or gas to generate enough energy to create heated liquid or steam. However, by coiling (preferably) a minimum of 1.5 meters of 2 mm outer diameter, 1 mm inner diameter copper pipe around 2×100 watt insulated metal elements or a 1×200 watt insulated metal element, along with additional pipe (secondary) to pre-heat the supply of liquid, it has been found that it is possible to generate heated liquid or steam using battery power This method allows the design of a portable machine with inbuilt batteries to allow 2-4 hours of operation (depending on the battery capacity) before recharging. The small reservoir tank 110 feeds either a unique chemical or water into 1.5 meters-4 meters of copper pipe under the influence of the peristaltic pump 150. The pump 150 is set to only allow fluid through for a constant feed (depending on the cleaning task at hand). Copper is used due to its fast transfer of heat to the liquid inside. Through testing, it has been discovered that in using a thin walled copper pipe, the liquid heats up more quickly, and it has been calculated that the amount of liquid required to remove chewing gum for this configuration of copper piping and heating elements is a flow rate (set at the pump 150) of 22 ml per minute.

The copper pipe 3 is repeatedly wound around the element 1 with a tight fit and then taken across to the second element 5 with a further continual tight-fitting coil around the second element 5. The secondary coil 8 which surrounds the two probes absorbs heat escaping from the primary coil 3, and transfers this to the liquid flowing through the secondary coil to effectively pre-heat the fluid to ensure that sufficient heated liquid or steam is emitted from the nozzle. The heated liquid or steam escapes through the escape 6 to the nozzle 120 which has a small brush attached which is used to agitate gum deposit to destroy a piece of discarded chewing gum in seconds. The method of using two coils and the above-described speed of fluid (22 ml per minute) delivery results in a device suitable primarily for use for chewing gum removal. It has also been found that the same result can be achieved by using a single 200 watt element with the same copper pipe coiled around and insulated with the heat resistant material. Two 12-volt batteries with an 8 amp output may be used to provide for at least 2 hours of continuous operation before a re-charge of the batteries is required.

By changing the configuration of batteries, heating elements and fluid delivery, there are numerous other uses including the removal of stickers and sticky adhesive residue, chemical free grout cleaning, chemical free general heated liquid or steam cleaning and chemical free weed killing. The device described with reference to FIGS. 1 and 2 is constructed for floor cleaning, however the same technology can also be used in a hand held device to clean vertical surfaces such as grout between wall tiles and also the removal of unwanted stickers and adhesive residues which is ever growing problem. A hand held device may allow chewing gum removal from difficult to reach places such as on top of and under seats in public places and on public transport or from under surfaces such as school tables, train tables and other difficult to clean places, where chewing gum is discarded as well as from all urban and carpeted surfaces.

FIG. 3 schematically illustrates a heating element wherein the pipe 3 is wrapped around a single heating element 1. In this embodiment, the heating of the fluid is less than the embodiment depicted in FIGS. 2A and B due to the absence of a second heating element 5. As such, in this embodiment, there is little or no generation of steam.

In FIGS. 3 and 4 the apparatus works in a similar way to that shown in FIG. 1 excepting that the coil 3 is wrapped around a single heating element 1 and housed within the hot liquid or steam dispensing end of a portable steam or liquid dispensing apparatus 200. Advantageously this means that the weight of the coil 3 and associated apparatus is contained at the end positioned towards the surface to be cleaned rather than in a separate backpack or 'tow-along' apparatus. This provides easier handling by the user. The liquid to be heated is pumped through a pipe 220 and into a coil 3 before being heated and being dispensed through a nozzle 230.

Some of the advantages of the present technique are:

(a) Silent operation, so it does cause noise pollution to the operator or anyone in the vicinity of the machine.

(b) The machine is lightweight, making it easy to operate and eliminating the risk of injury, repetitive strains or long term ill effects to the operator. The lightweight (and folding) design also makes storage and transportation simple.

(c) Inexpensive materials and methods are required, which means that the machines will cost much less than traditional machines for steam generation and chewing gum removal. The existing machines can cost many thousands of pounds for even entry-level machines and a power source is still required, which is an additional and ongoing cost.

(d) Major reduction in cost of operating a steam cleaning device as a full charge to the batteries will cost a few pence rather than using gases or a petrol/diesel generator.

(e) The machines are portable—eliminating or at least mitigating the requirement for the operator to wear a heavy backpack, carry a weighty hand held lance or have to manoeuvre a weighty machine and generator. There are also no trailing leads or hoses to consider. The operator will also be able to work in confined spaces, as the device is compact.

(f) None of the risks associated with using gases to heat the water, or having to use electricity from a powerful generator or mains source around the presence of water.

(g) The option of having a set flow rate on the device allows the operator to have a 'plug and play' experience. This means no need for extensive training of individual operators or associated problems of confusion over multiple machine settings.

(h) Environmentally friendly operation due to the use of rechargeable batteries rather than having to use fuels such as LPG/Propane, petrol or diesel, which are not from renewable sources.

(i) Safe to use in all locations as no LPG/propane or highly flammable fuel for a generator is used. This will make the cleaning process much easier in sensitive locations such as major transport hubs (particularly underground/subway stations and airports), service station forecourts (where there is an unacceptable risk to machines using an internal flame) and places where a risk assessments would prohibit the use of explosive fuels from being used.

The portable heated liquid device may also be fitted into existing or new cleaning machines to allow them to clean with heated water or other heated fluids, improving the efficiency of cleaning machines which are already in use instead of requiring existing machines to be replaced with those containing the new, heating component.

The invention claimed is:

1. A portable liquid or steam dispensing apparatus, comprising:

a battery;

a heating element;

a liquid reservoir;

a pump;

an outlet; and a pipe, extending from the liquid reservoir to the outlet and passing adjacent to the heating element;

wherein, in operation, the pump drives liquid from the reservoir into and through the pipe while the battery causes the heating element to heat the liquid passing through the portion of the pipe adjacent to the heating element to be expelled from the outlet as a heated liquid at a temperature greater than the ambient temperature; and wherein the temperature of the heated liquid is controlled via the voltage of the battery.

2. The portable liquid or steam dispensing apparatus according to claim 1, wherein the portion of the pipe passing adjacent to the heating element is coiled around the heating element.

3. The portable liquid or steam dispensing apparatus according to claim 2, wherein the pipe is coiled around a second heating element.

4. The portable liquid or steam dispensing apparatus according to claim 3, wherein the pipe is coiled around the heating element and the second heating element individually to form a coiled heating unit, and wherein the pipe is further coiled around the coiled heating unit.

5. The portable liquid or steam dispensing apparatus according to claim 3, wherein the pipe is a copper pipe.

6. The portable liquid or steam dispensing apparatus according to claim 5, wherein the copper pipe has an inner diameter of approximately 1 mm.

7. The portable liquid or steam dispensing apparatus according to claim 5, wherein the copper pipe has an outer diameter of approximately 2 mm.

8. The portable liquid or steam dispensing apparatus according to claim 5, wherein the pump is operable to drive liquid from the reservoir at a rate of approximately 22 ml per minute.

9. The portable liquid or steam dispensing apparatus according to claim 1, wherein the heating element is proximate the outlet.

10. The portable liquid or steam dispensing apparatus according to claim 1, further comprising a housing, wherein the battery is contained within or mounted onto the housing.

11. The portable liquid or steam dispensing apparatus according to claim 1, wherein the heating element and the portion of the pipe adjacent to the heating element are mounted within a heat insulating material.

12. The portable liquid or steam dispensing apparatus according to claim 1, wherein the liquid comprises water.

13. The portable liquid or steam dispensing apparatus according to claim 1, wherein the liquid comprises a chemical.

14. The portable liquid or steam dispensing apparatus according to claim 1, further comprising a brush, wherein the outlet dispenses the liquid through or adjacent to the brush.

* * * * *